US009415259B2

(12) United States Patent
Ramdas

(10) Patent No.: US 9,415,259 B2
(45) Date of Patent: Aug. 16, 2016

(54) TRAINING DEVICE

(71) Applicant: Saileshkoemar Ramdas, Leiden (NL)

(72) Inventor: Saileshkoemar Ramdas, Leiden (NL)

( * ) Notice: Subject to any disclaimer, the term of this patent is extended or adjusted under 35 U.S.C. 154(b) by 39 days.

(21) Appl. No.: 14/373,349

(22) PCT Filed: Jan. 21, 2013

(86) PCT No.: PCT/NL2013/000001
§ 371 (c)(1),
(2) Date: Jul. 19, 2014

(87) PCT Pub. No.: WO2013/109141
PCT Pub. Date: Jul. 25, 2013

(65) Prior Publication Data

US 2014/0357456 A1 Dec. 4, 2014

(30) Foreign Application Priority Data

Jan. 20, 2012 (NL) ..... 1039309

(51) Int. Cl.

| | |
|---|---|
| ***A63B 22/00*** | (2006.01) |
| ***A63B 21/22*** | (2006.01) |
| ***A63B 23/035*** | (2006.01) |
| ***A63B 23/04*** | (2006.01) |
| ***A63B 23/12*** | (2006.01) |
| *A63B 21/008* | (2006.01) |
| *A63B 21/015* | (2006.01) |

(52) U.S. Cl.

CPC ..... *A63B 21/225* (2013.01); *A63B 21/4047* (2015.10); *A63B 22/0007* (2013.01); *A63B 22/0023* (2013.01); *A63B 23/0355* (2013.01); *A63B 23/0429* (2013.01); *A63B 23/1209* (2013.01); *A63B 21/008* (2013.01); *A63B 21/015* (2013.01); *A63B 2208/0233* (2013.01); *A63B 2208/0238* (2013.01); *A63B 2225/09* (2013.01)

(58) Field of Classification Search

USPC ..... 482/1–148

See application file for complete search history.

(56) References Cited

U.S. PATENT DOCUMENTS

| | | | | |
|---|---|---|---|---|
| 2,603,486 | A | 7/1952 | Hughes | |
| 4,728,099 | A | 3/1988 | Pitre | |
| 6,500,099 | B1 * | 12/2002 | Eschenbach | A63B 21/062 482/121 |
| 6,547,701 | B1 * | 4/2003 | Eschenbach | A63B 22/001 482/57 |
| 6,645,129 | B2 * | 11/2003 | Eschenbach | A63B 21/062 482/121 |
| 6,830,538 | B2 * | 12/2004 | Eschenbach | A63B 21/00178 482/52 |
| 7,497,808 | B2 * | 3/2009 | Eschenbach | A63B 22/001 482/51 |

(Continued)

FOREIGN PATENT DOCUMENTS

| | | | |
|---|---|---|---|
| DE | 10 2008 026141 | A1 | 12/2009 |
| EP | 2 383 020 | A1 | 11/2011 |

(Continued)

*Primary Examiner* — Stephen Crow

(74) *Attorney, Agent, or Firm* — Shewchuk IP Services, LLC; Jeffrey D. Shewchuk

(57) ABSTRACT

A device for training the body of a user (1) includes a mechanism (2) with levers (3) arranged to be operated by no more than two limbs of the user. The levers are linked to a flywheel configuration (4) such that the flywheel configuration is actuated/driven by periodic push and/or pull forces exercised by the user to those levers. The resistance of the flywheel configuration can be varied. The device can be put into at least two orientations with respect to a base plate (13), so that the levers are moved by the user either forward and backward or upward and downward. The levers are arranged to be actuated by either the user's hands or the user's feet.

16 Claims, 8 Drawing Sheets

(56) References Cited

U.S. PATENT DOCUMENTS

| | | | | |
|---|---|---|---|---|
| 7,993,247 | B1 * | 8/2011 | Eschenbach | A63B 22/001 482/51 |
| 2007/0021276 | A1 | 1/2007 | Kuo | |

FOREIGN PATENT DOCUMENTS

| | | | |
|---|---|---|---|
| GB | 2 175 812 | A | 0/1896 |
| WO | 2005/107882 | A1 | 11/2005 |

* cited by examiner

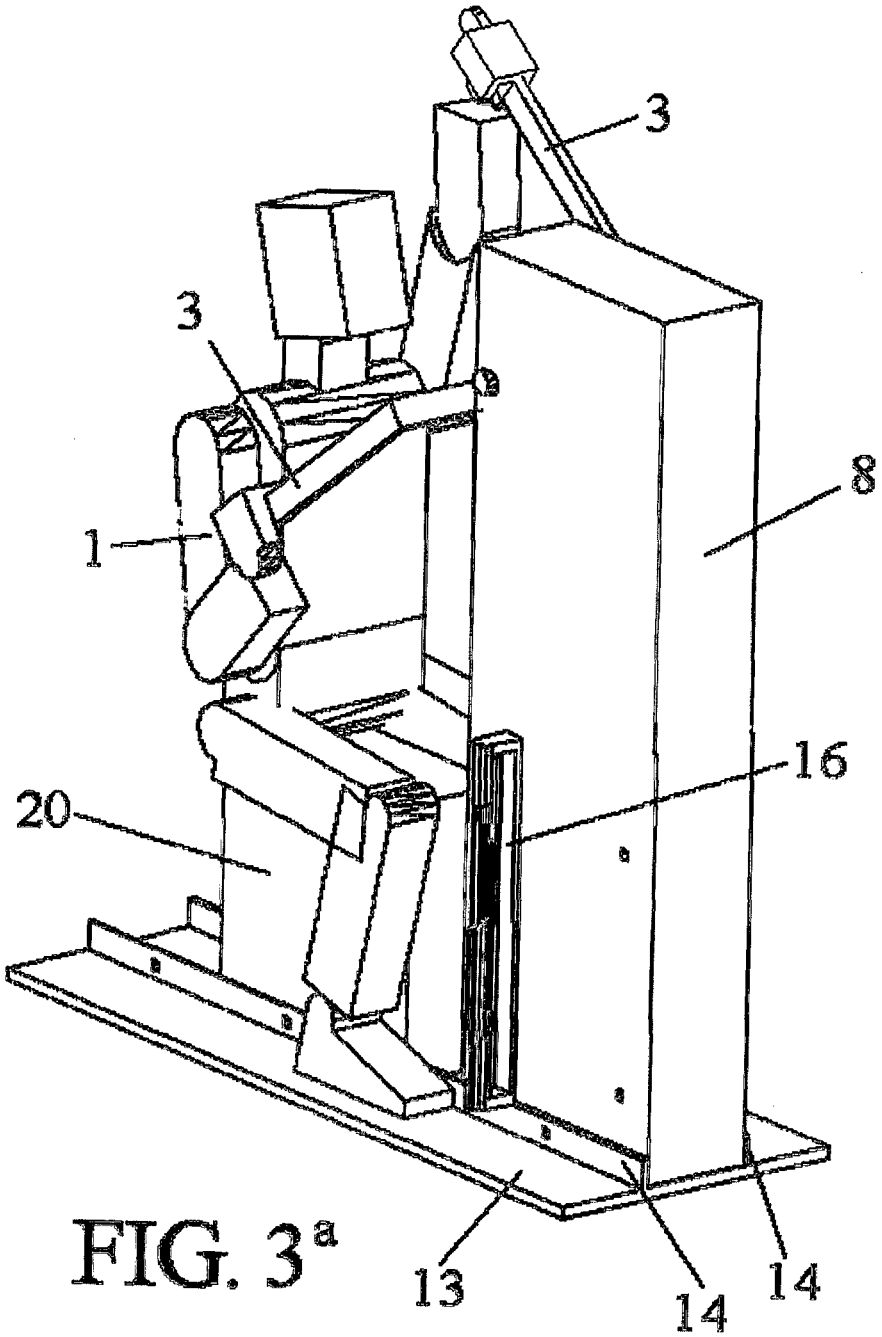
FIG. 3[a]

TRAINING DEVICE

BACKGROUND OF THE INVENTION

The invention relates to a device for training the body of a user, including a mechanism arranged to be operated by limbs of the user.

Such devices, sometimes called crosstrainers, are, in general, in use in fitness centres or sport schools for condition or strength training. Crosstrainers are devices provided with a combination of foot pedals and movement arms, by means of which a flywheel configuration can be driven by the user. By means of the foot pedals the apparatus (i.e. the flywheel configuration) is brought into and kept in movement, wherein the movement arms move along with the foot pedals. The movement arms are not primarily used to bring the apparatus into and keep in movement. The strength is especially originating from and exercised by the user's legs, exercising a circular/elliptic driving movement to the foot pedals or foot bars, due to which the known crosstrainer is fit for condition training but not for strength and muscle training (the flywheel configuration is mainly actuated/driven by the foot pedals or foot bars and the arm movements are mainly auxiliary/dependent).

U.S. Pat. No. 2,603,486 discloses a training apparatus comprising two arms, where, however, each of them must (simultaneously) be operated by both arms and legs of the user (each lever has a hand grip and a foot pedal). In this well-known apparatus a flywheel is operated via connection rods linked to a large pulley. By means of a belt between the large pulley and a small pulley, which is attached to the flywheel, the movement of the levers is transferred to the flywheel. This arrangement of two connecting rods positioned 180.degree. apart on a pulley or crank has the disadvantage that two dead centre positions are obtained when the levers, moving in opposite phase, are in their extreme positions. These dead centre positions also cause a non-smooth movement of the levers in their extreme positions, which is unpleasant for the user. Furthermore the training apparatus of U.S. Pat. No. 2,603,486 suffers from the disadvantage that the user must stop the movement of flywheel and the linked levers by applying considerable effort.

U.S. Pat. No. 4,728,099 discloses another training apparatus, which must be operated with the legs of the user. In this well-known apparatus belts and belt wheels are used for operating a flywheel.

SUMMARY OF THE INVENTION

The invention is a new device, wherein the flywheel is brought into movement and kept in movement by means of a maximum of two movement arms or levers and —contrary to crosstrainers—not by means of foot pedals or foot bars and dependently moving hand levers. By exerting a push-and-pull movement of only the hands/arms—or possibly only the feet/legs- to the maximum of two movement arms/levers, much more strength and muscle power must be used by the user of the new device in comparison to the known devices provided with arm and leg levers.

The device according to the present invention has no foot pedals like the known devices (crosstrainers) and, preferably, can be actuated and operated both horizontally and vertically: the movement arms can move then forward/backward or upward/downward. This optional feature according to the invention is not possible in the known devices, which are driven by foot pedals or by a combination of legs and arms (a combination of foot pedals or bars and arm levers).

The invention thus provides a device for training the body of a user, operated by a maximum of two limbs at the same time, including two levers and a flywheel configuration linked to said two levers. The flywheel configuration is actuated/driven by periodic push and/or pull forces exercised by the user's two limbs to those two levers.

Preferably, two levers linked to the flywheel configuration are arranged such that the levers move dependently of each other and in opposite phase. Furthermore the mechanism preferably comprises means for varying the rotation resistance of the flywheel configuration, for example by an adjustable brake shoe or brake band around the flywheel. Preferably, e.g. by means of oil or air cylinders with adjustable leak, means may be provided for varying the motion resistance of said two levers.

The mechanism may be arranged so that one or both levers make a movement in a mainly geometrical flat plane or possibly in a geometrically bent plane.

Preferably, the device is provided with means arranged to set, move or mount either the mechanism including the two levers or the whole device (including its housing) into different positions with respect to its horizontal floor plate. Preferably the mounting allows the user to choose whether the two levers can be actuated by the user either in mainly forward/backward or in upward/downward direction. The device may include a housing, which is fit to cooperate with a ground frame and arranged to be connected to the frame in various different positions, horizontally, vertically or slanted to the floor. A tilting mechanism can allow movement of the mechanism (including the levers) and/or the complete device into various desired positions.

The levers can be arranged to be actuated by the user's hands or, possibly, by the user's feet, however, not simultaneously by the user's legs and arms as in well-known devices.

According to a preferred embodiment of the invention each lever is hinged at a first location to the fixed frame of the device, whereas each lever is linked at a second location by means of a connection rod to the flywheel configuration.

In an alternative embodiment of the present invention the flywheel configuration of the device comprises a freewheel mechanism.

Advantageously the mechanism comprises a crank, a crank axle and connecting rods, mounted between the crank and the levers, wherein an auxiliary mechanism provides momentum to the crank in dead centre positions of the connecting rods on the crank.

In particular the auxiliary mechanism comprises a cam on the crank axle and a spring-loaded follower on the cam surface; preferably the follower comprises a support lever, a wheel and a spring; more preferably the spring is a torsion spring mounted between an end of the support lever and the device frame.

With these measures the dead centre positions, being responsible for the (to the user) unpleasant non-smooth movement of the levers in their extreme positions, are forcibly counteracted by a momentum exerted on the cam plate and the coupled crank axle.

With the device according to the invention the following practical advantages are reached:

Time Profit

Condition- and strength training is carried out with this apparatus in one movement. At the current form of fitness nearly all muscles and the condition is trained separately from each other and approx. 60-90 minutes is needed for a complete training. With the device according to the invention condition, strength and several muscle groups of the body are trained in one movement (and one apparatus). A complete effective training can be done in only 10-15 minutes.

Preventing of Injuries and Overload

The new device presented here prevents/limits injuries and overload of muscles and/or joints. In the current form of strength training one trains on devices with weights. To make the movement more difficult one must increase the weight. Training with weights is in and of itself already dangerous. The heavier the weight the more dangerous this becomes for the muscles and joints. In consequence overload and injuries occur regularly. Also many movements are needed to train/charge a muscle group. Many people, in particular new customers, do not know the right movements and frequently copy their movements from others. This, however, often leads to incorrect movements, further increasing the incidence of injuries and overload of muscles and joints (among other things back pain).

By use of the new device for strength training presented here, only one determined movement is used. A wrong movement is excluded because of this. By the fluent and natural push and pull movement and by gradually increasing the resistance, overload and injuries are prevented.

Fit for Rehabilitation

This apparatus is ideal for rehabilitation. The fluent, continuing repetitive movement and the gradually increasing resistance makes this apparatus ideal for rehabilitation training. The muscles will be made gradually stronger with this apparatus. For people with restrictions of the lower part of the body (knees, hips etc.) this apparatus offers very good and more extended possibilities in doing condition training. With the current apparatuses condition training is generally only possible by actively moving legs or a combination of legs and arms. This new apparatus offers the possibility of training the condition with only the arms or only with the legs.

Suitability for Adolescents

In the current form of strength training insufficient account is taken with adolescents. It has not desirable for adolescents to train with (heavy) weights. Due to the natural push and pull movements, the device according to the invention is a good alternative for adolescents who want to do fitness/strength training.

Suitability for the Elderly

This apparatus is suitable for all age groups. However specific for the elderly this apparatus offers the possibility of keeping and reinforcing the muscles and muscle functions optimum in a natural way of movement. Especially for the elderly natural movement is very important.

More Effective Training/Faster Result

Not only by the combination of condition and strength training but especially by the fluent repetitive movement, duration training for the muscles is realised. This includes that a faster strength increase and combustion will be realised than using the current form of strength training.

The use of no more than two driving levers is essential in the present invention, with which (two) levers, actuated by two arms or two legs of the user (never his/her arms and legs at the same time), a flywheel (configuration) is driven via connection rods linked between the flywheel configuration and the levers.

The invention, preferably, provides means which are arranged to enable to put (move/mount) the training apparatus into different positions, thus enabling the apparatus to be fit for training various, completely different muscle groups. Such means arranged for (dynamically or more statically) setting the training apparatus into different positions is also neither known from nor suggested in any of said disclosures. Provisions to enable setting the (base) apparatus into different positions forms an important aspect of the invention: because of this aspect various, completely different muscle groups can be trained with the same (base) training apparatus, set/mounted in different (horizontal, vertical) positions.

In this way a range of fitness apparatuses, as it were, can be formed, where every apparatus from that range is based on the same principle and uses basically the same basis module, however provided with means by which (the basis module of) the training apparatus can be put into different positions, as a result of which several muscle groups can be trained, always by bringing into movement and keeping in movement a flywheel with adjustable resistance and using (in all cases) not more than two back-and-forth or up-and-down moving actuation levers.

Every model in the range-formed by the (base) training apparatus mounted/established in its different positions-requires a specific physical body attitude (posture) of its user, invites or challenges the user to exercise a specific movement or appeals to a specific muscle group.

The ongoing repetition of the movements of the arms or legs keeping the flywheel in rotation, stimulates the blood circulation, raises the condition, ensures fat combustion in the concerning muscle group and promotes, in case of injuries, rehabilitation in the concerning muscle group. The range of apparatuses can be used by all target groups: adolescents, elderly, disabled, injured, beginning and advanced users. By adjusting the resistance of the flywheel the muscle strength and muscle mass is stimulated.

The flywheel principle was so far applied within the cardio area of the fitness branch. It becomes also applied now within the strength training and bodybuilding area. In this way the flywheel principle can mainly or even completely replace training with weights. Strength training is no longer characterized by lifting weights, but putting into and keeping in rotation a flywheel with controlled rotation resistance. An additional aspect is that the risk of injuries will be reduced. Moreover, any (psychological and/or physical) threshold to strength training (which rather has a macho imago) is considerably reduced. Particularly for women this will be of importance: it is much more attractive for women now to train their abdomen, buttocks, legs and arms.

BRIEF DESCRIPTION OF THE DRAWINGS

Hereafter the invention will further be discussed by means of some exemplary embodiments, with reference to some figures.

FIG. 3*a-b* show schematically two alternatives of the same exemplary embodiment of the device, by tilting of the housing established for performing up and downward movements of the arms of the user;

DETAILED DESCRIPTION OF THE PREFERRED EMBODIMENTS

Figure 1:
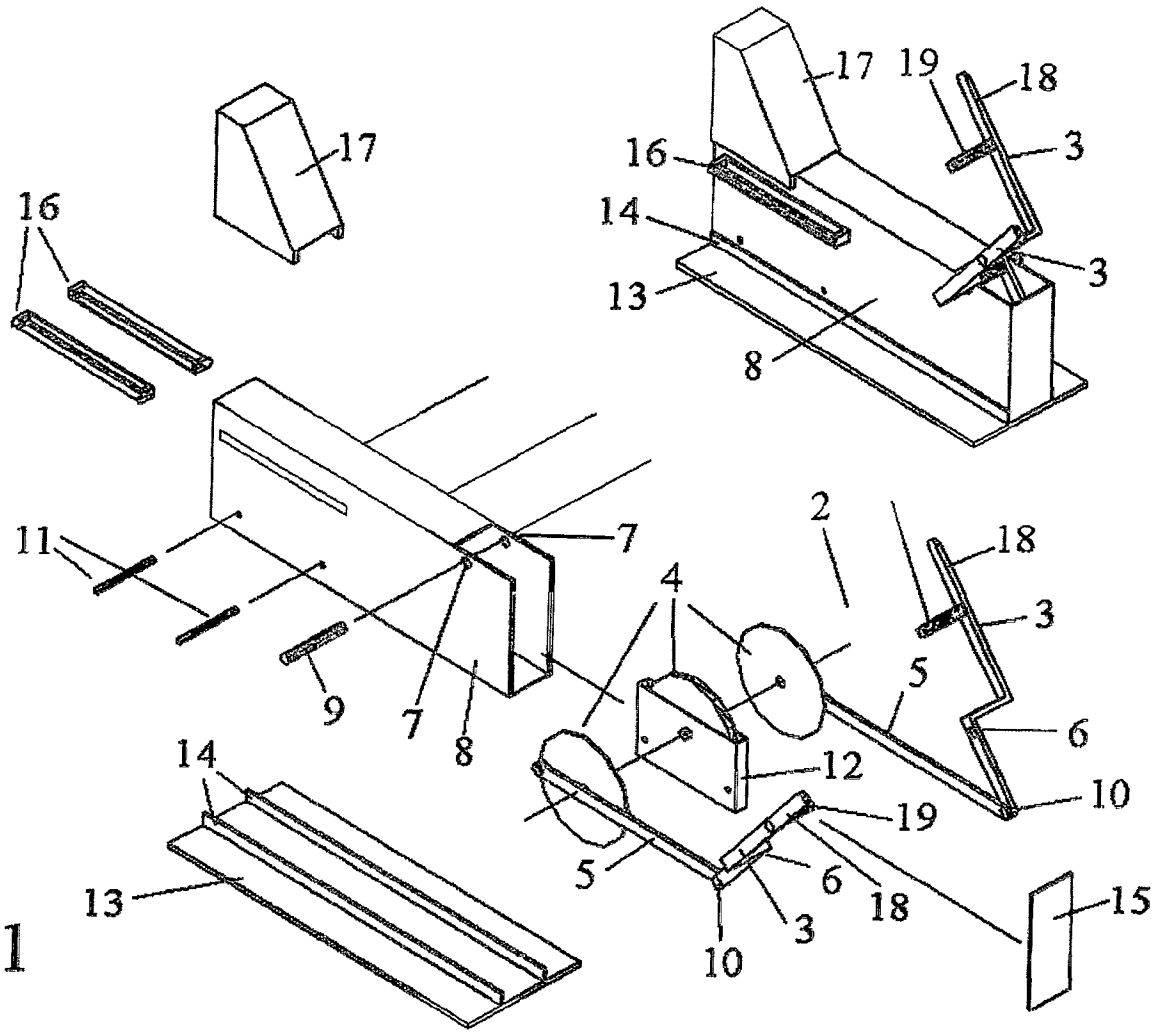
FIG. 1 shows schematically an exemplary embodiment of a device according to the invention in perspective, both in exploded view and in assembled situation.

The FIGS. 1-8B all show a device for training the body of a user 1 (only explicitly shown in the FIGS. 2-4), including a mechanism 2 which is arranged to be operated (actuated/energized) by limbs of the user 1, which mechanism 2 is provided with two levers 3 which can be operated by the user 1 and which levers 3 are in connection with means which are arranged for exerting a force to those levers. The mechanism 2 includes a flywheel configuration 4 that is linked such with said two levers 3 that the flywheel configuration 4 rotates as a result of periodic push and/or pull forces exercised by (no more than) two limbs of the user, i.e. the user's arms or the user's legs, to those two levers 3. The two levers are connected such with the flywheel configuration 4—by means of connection rods 5 that the levers 3 move in mutual opposite phase. Preferably the flywheel configuration 4 is provided with a freewheel mechanism like a freehub, which disengages the flywheel from the driving crank or the pulley, linked with the connection rods 5, when the driving crank rotates slower than the flywheel. As a result the user is not forced to stop the movement of the levers 3 by stopping the flywheel, but may stop at any moment with the training, because due to the freewheel the levers will not continue with moving when user stops exerting force to the levers. Not visible in the figures is that the mechanism includes means for varying the rotation resistance of that flywheel configuration 4, for example an adjustable brake shoe against the flywheel configuration 4. Optionally the mechanism 2 can also include means for varying the movement resistance of the levers 3, for example cylinders with an adjustable leak between both cylinder chambers. The mechanism 2 is arranged such, by the bearing/conductance of the levers 3, that the levers each make a movement in a mainly geometrically flat plane. The mechanism may also, by a modification of the bearing of the levers 3 into a not-flat guiding path, arranged such that the two levers 3 each make a movement in a geometrically bent area or arc.

FIG. 1 shows that each lever 3 is pivotally connected, at a first location 6, to a fixed point 7 of the device, in this case a housing 8 that also serves as a frame, and through which a bearing axle 9 extends. Furthermore each lever 3 is joined with the flywheel configuration 4 at a second location 10 by means of the connection rod 5. That flywheel configuration 4 is installed in the frame 8 by means of two connection rods 11 inserted into the housing 8 and the frame 12 of the flywheel configuration 4. Furthermore FIG. 1 shows a floor or base plate 13, provided with a pair of slides 14 for catching the housing 8, both in the lying (horizontal) position as well as in the standing (upright) position which will be discussed below. In both positions the housing 8 is bolted then between the slides 14 to the base plate 13, for example by means of locking rods (not shown) inserted into openings in the slides 14 and the housing 8.

Further, a locking plate 15 is visible, provided for locking the head part of the housing 8. Furthermore two elongated stationary handrails 16 are provided at both sides of the housing 8, and a movable body support 17. The levers 3 are each provided with a handgrip 18 and with a transversely placed footrest 19.

Figure 8A:
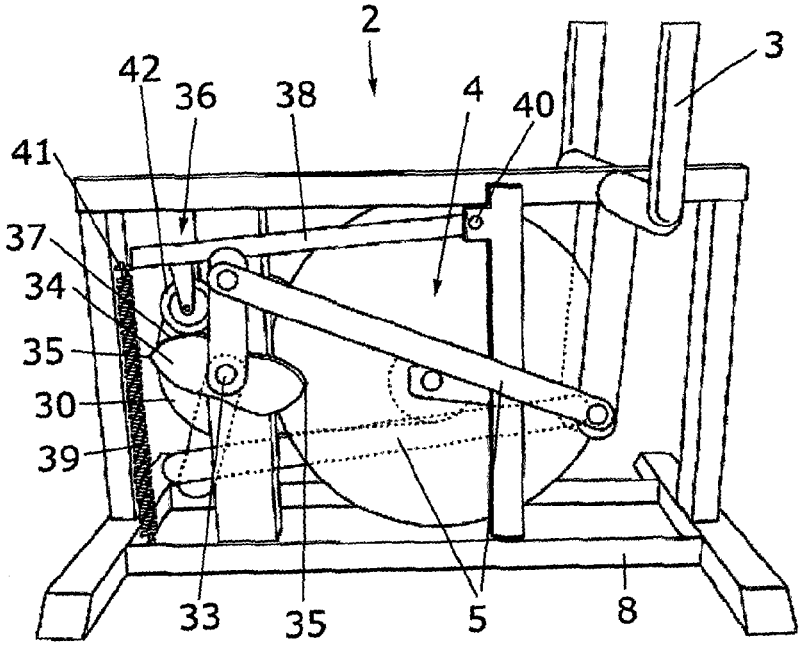
FIGS. 8A & 8B show in two opposing side views an alternative embodiment of the mechanism and the flywheel configuration of the device according to the invention.
Figure 8B:
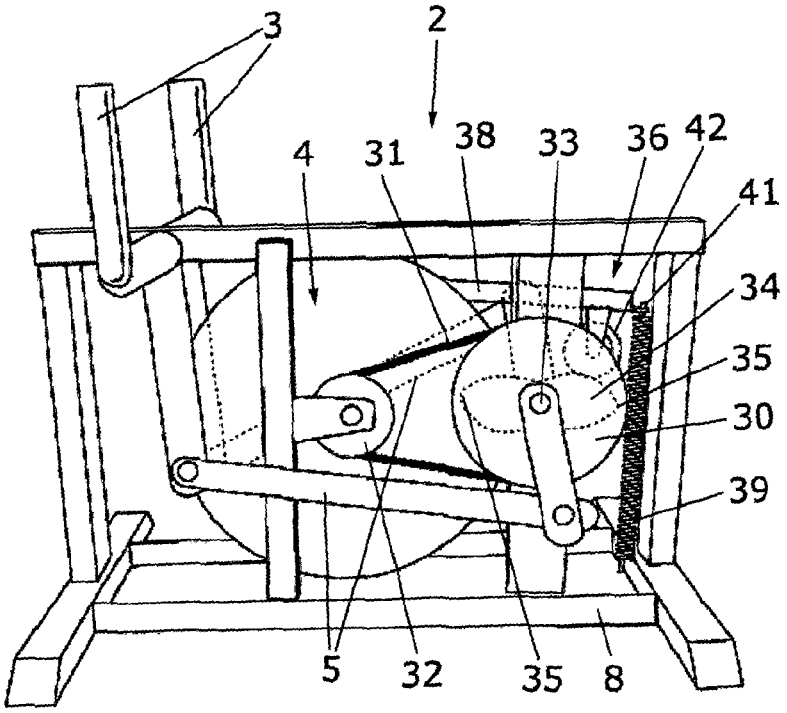

FIGS. 8A and 8B show an alternative embodiment of the flywheel configuration 4 of the device of the present invention. In this example the levers 3 are linked to a crank or pulley 30 by means of connecting rods 5. By means of a belt 31 pulley 30 drives a small pulley 32 attached onto the flywheel 4. The flywheel is preferably provided with a freehub (freewheel) so that the rotational motion of the flywheel is not returned to the small pulley 32 when the rotational movement of the flywheel is higher than that of the (small) pulley 32, thereby preventing continued movement of the linked levers 3.

In order to overcome both dead centre positions due to the arrangement of the two connecting rods 5 180° apart (moving in opposite phase) on the pulley crank 30, the dead centres being responsible for the (to the user) unpleasant non-smooth movement of the levers in their extreme positions, an auxiliary mechanism is provided acting on the crank axle 33. The auxiliary mechanism provides an additional force onto the crank axle 33 dependent upon the position of the connecting rods 5 on the crank 30. Because for each revolution of the crank 30 two dead centre points must be passed, the auxiliary mechanism must act in a twice as high frequency as the rotational frequency of the crank 30. This can be accomplished, for example, by driving a (sprocket) wheel in double ratio by a chain or a belt, the wheel being provided eccentrically with a spring attached to the frame 8 or housing of the device. In an alternative embodiment of the auxiliary mechanism, shown in FIGS. 8A & 8B, the crank axle 33 is provided with a cam plate 34 having two bumps 35 for double frequency. The cam plate rotates with the same frequency as the crank 30. A spring-loaded follower 36 is positioned upon the cam surface 37, such that the follower 36 in the dead centre positions of the crank 30 exerts additional rotational momentum to the crank axle 33. In this example the follower 36 is constructed from a support lever 38, with its first end 40 pivotally connected to the device frame 8 and with its second end 41 connected to the frame by means of a tension spring 39. Alternatively the follower 36 can also be connected to the frame by using a compression spring. In this example the follower comprises a wheel 42, which is arranged to roll over the cam surface 37. When the crank approaches a dead centre position the support lever 38 is moved upwards by bump 35 of the cam plate 34 thereby stretching the tension spring 39 so that an opposing force or momentum is exerted by the wheel 42 on the cam plate 34 and the coupled crank axle 33, whereby the crank is forcibly moved through its dead centre position.

Figure 2:
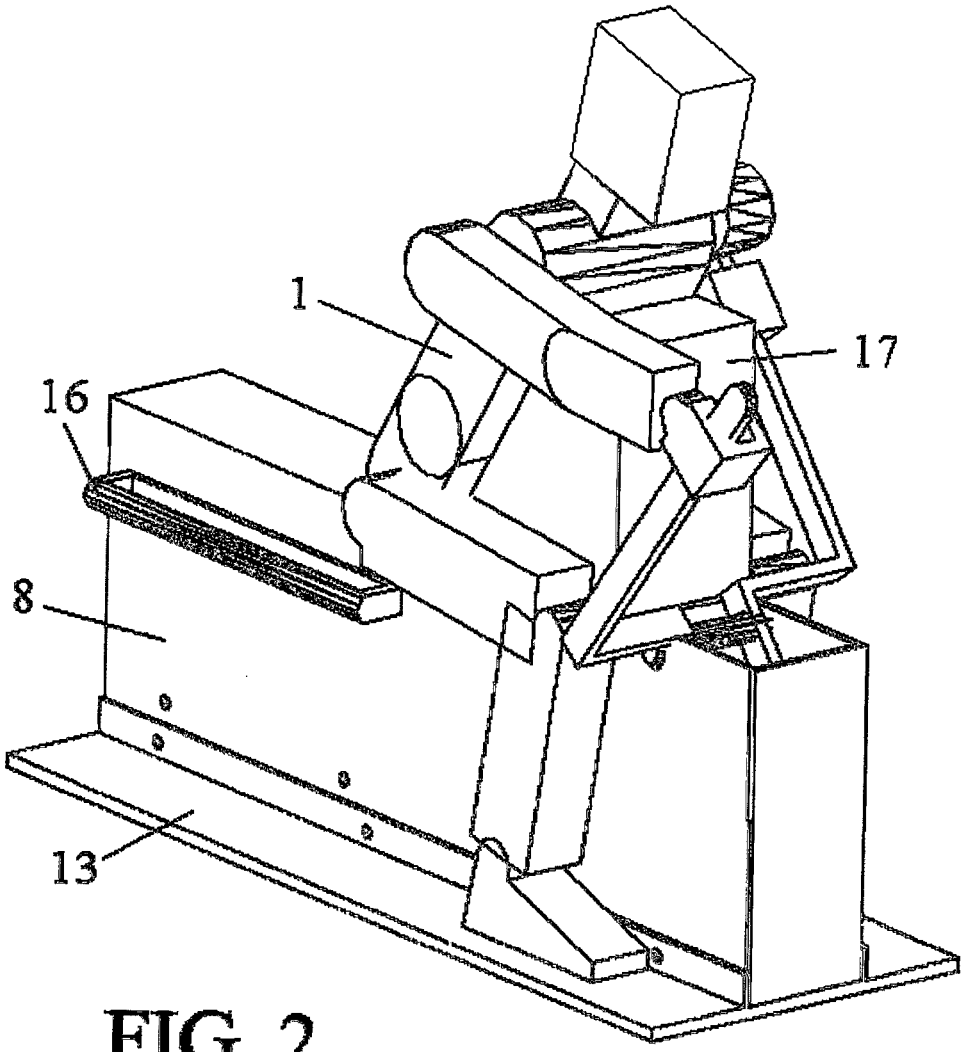
FIG. 2 shows schematically the same exemplary embodiment as shown in FIG. 1, established for (curvilinear) forward and backward movements of the arms of the user.

FIG. 2 shows the same exemplary embodiment as FIG. 1, established for performing upward and downward movements of the arms of the user 1. In this situation the body support 17 is turned, with its slanting side, to the body of the user 1 and functions thereby as a breast support. It is noted that, of course, in practice both the body support 17 has a more rounded design and is provide with an elastic material, which is better visible in the last three figures.

The housing 8 including the mechanism 2 can be mounted and then bolted in several positions on the base plate 13 by using the slides 14. FIG. 2 shows the situation where the two levers 3 are moved mainly forwardly and backwardly by the user 1.

FIG. 3*a* shows the same device, where the housing 8 is tilted now over 90° and thus mounted vertically on the base plate 13, as a result of which the two levers 3 are located mainly above the torso of the user 1 and must be moved (curvilinearly) up and down. The user 1 can carry out this movement sitting, by means of sitting module 20 that is also introduced between the slides 14 and then fixed.

Figure 3B:
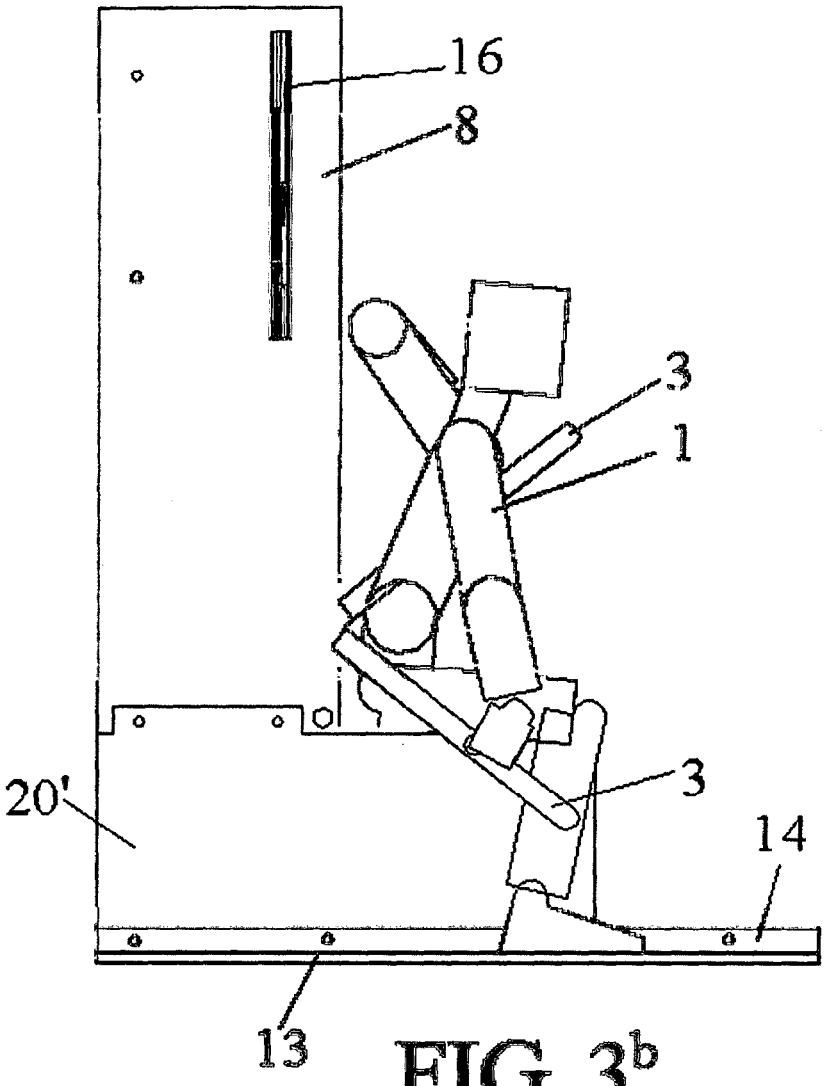

FIG. 3*b* shows the same device, where the tilted housing 8 is mounted now so that the two levers 3 must be moved up and down by the user 1 below the user's torso. The user 1 can perform this movement by sitting on a sitting module 20' that in this case is extended with a console (left part in the figure) on which the vertical housing 8 has been mounted. In this implementation the levers 3 are located therefore lower than in the (vertical) implementation shown in FIG. 3*a*.

Figure 4:
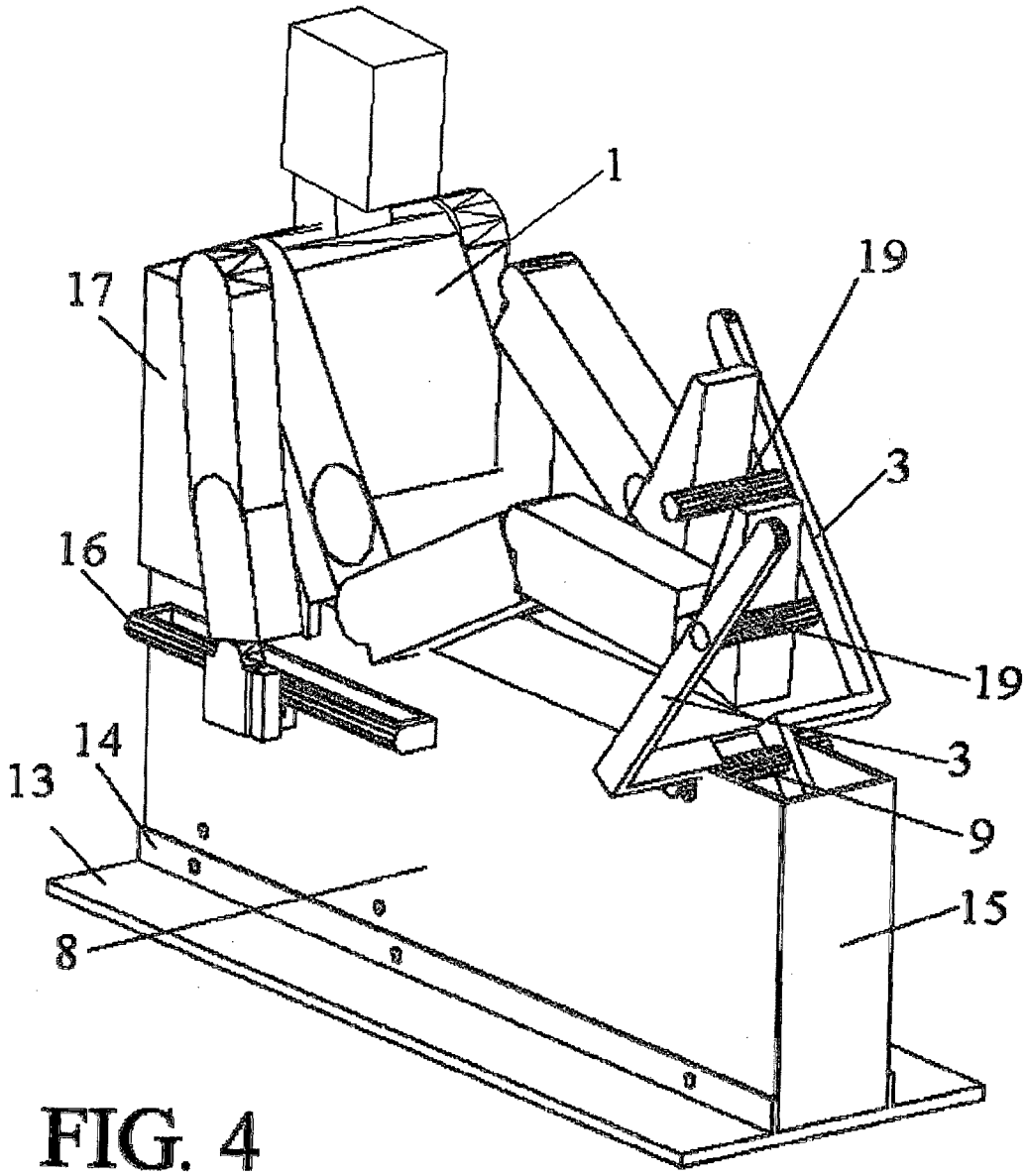
FIG. 4 shows schematically the same exemplary embodiment, in a tilted-back housing and established here for performing movements of the legs of the user.

FIG. 4 shows the same device, however now established for performing movements of the legs of the user 1. To that end the body support 17 is moved backwards and is used in this embodiment as a back support. The feet of the user 1 will bring the flywheel configuration (not shown here) within the housing 8 into rotation by kicking alternatively against the one and the other lever 3, by means of the footrests 19.

The same module is always used in the various implementations, substantially formed by the housing 8 and the mechanism 2, including the levers 3, the flywheel configuration 4, the connection rods 5 etc., however adapted so that the user 1 can carry out different movements to train different muscles. An overview of the various different muscle groups which can be trained in the different embodiments/configurations of the device, successively shown in the FIGS. 2-4, follows below. The underlined muscle groups are in particular trained in the referenced embodiment/configuration:

Embodiment Shown in FIG. 2

Position apparatus: horizontal
Movement: forward push movement and a simultaneously backward pull movement
Active muscles:
Breast and Back Muscles
Shoulder muscles, particularly the frontside shoulder muscles
Arm muscles; triceps, biceps and forearm muscles.

Embodiment Shown in FIG. 3*a*

Position apparatus: vertical, movement arms up
Movement: upward push movement and a simultaneously downward pull movement
Active muscles:
Shoulder, Back and Breast Muscles
Arm muscles; triceps, biceps and forearm muscles.

Embodiment Shown in FIG. 3*b*

Position apparatus: vertical, movement arms on sitting level or something higher
Movement: upward pull movement and a simultaneously downward push movement
Active muscles:
Arm muscles; triceps, biceps and forearm muscles
Shoulder and back muscles
Breast muscles
Abdomen muscles (particularly the obliques)

Embodiment Shown in FIG. 4

Position apparatus: horizontal, legs
Movement: forward push movement of the one leg and a simultaneous returning movement of the other leg
Active muscles:
Leg muscles; front and back side (quadriceps/hamstring) and calves
Buttock muscles
Abdomen muscles Finally still some figures showing an improved design of a number of the above discussed configurations will briefly be discussed.

Figure 5:
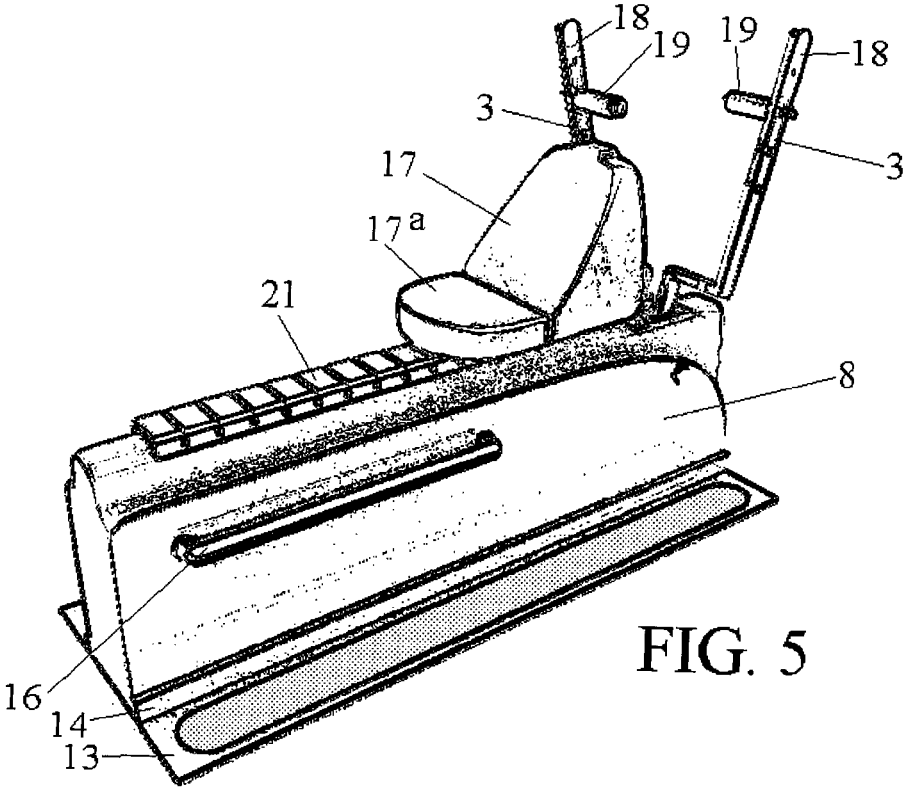
FIG. 5 shows, considered technically, the same exemplary embodiment, however here more attractively designed, established for performing forward and backward movements of the arms of the user.

FIG. 5 shows the same embodiment as in FIGS. 2-4, here—as far as can be shown by means of the (regulative) black-line drawings—having an improved design, arranged for exercising forward and backward movements by the arms of the user. The body support 7 is provided with a padded sitting part 7*a*, which is adjustable by means of a connection rail 21.

Figure 6:
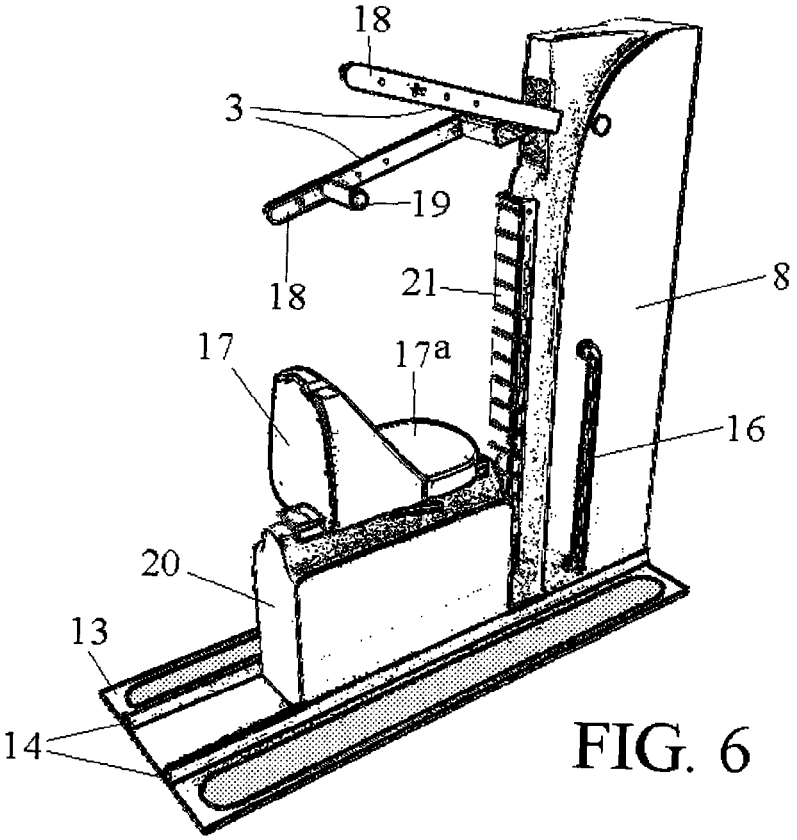
FIG. 6 shows the same exemplary embodiment as FIG. 5, established for performing up and downward movements of the arms of the user.

FIG. 6 shows the same device, however, established now for performing of up and downward movements of the arms of the user 1. The connection rail 21 can be coupled to the sitting module 20 for increasing the rigidity of the whole device, of which the housing 8 stands upright in this situation.

Figure 7:
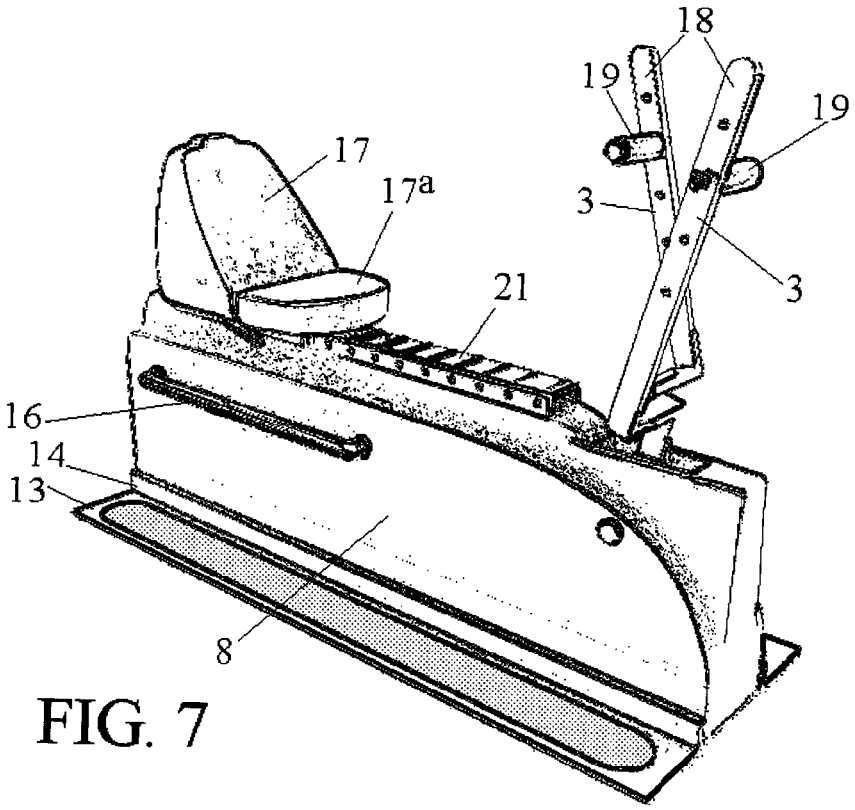
FIG. 7 shows the same exemplary embodiment as FIG. 5, established here for performing movements of the legs of the user.

Finally, FIG. 7 shows the same device, however now established for performing movements of the legs of the user 1. When the device is used to be operated/actuated by the arms of the user 1, namely for training of the torso and the internal organs such as heart and lungs, the footrests 19 can alternatively be used as hand grips if the user 1 prefers so. The design of the hand grips 18 and footrests 19 is such that either the hand grips 18 or the footrests 19 can be used by either the hands or the feet, for example alternatively, which certainly will advance the exercises.

Thus the invention provides a training apparatus (or an integrated series of training apparatuses always using the same base module) which is intended and arranged for condition training and strength training, in particular intended for average and in a certain way somewhat vulnerable user groups which, by using this new apparatus, can improve, within limited time, their condition and muscle strength substantially without chance on injuries or overload. To this end the apparatus provides the means to train only (maximum) two limbs always by means of a fluent and regular movement, with which both muscles and the heart and lung functions are perfectly trained.

The invention claimed is:

1. A device for training the body of a user by using no more than two limbs of the user at the same time, comprising: a base for situating the device on a floor; two levers to be operated by said no more than two limbs of the user, the two levers being supported by the base so as to be driven by periodic push and/or pull forces provided by said no more than two limbs of the user; a flywheel linked with said two levers and supported by the base, such that movement of the two levers causes rotation of the flywheel, with the flywheel resisting at least relatively fast movement of the two levers; and an auxiliary linking mechanism comprising: a cam riding on a crank which is rotationally driven by movement of the two levers, the cam providing a cam surface, connection rods mounted between the crank and the two levers, and a spring-loaded follower riding on the cam surface, with spring force providing momentum to the crank in dead centre positions of the two levers in their linkage relative to the crank.

2. The device according to claim 1, wherein the two levers are linked to the flywheel such that the two levers move dependently of each other and in opposite phase.

3. The device according to claim 1, comprising means for varying rotational resistance of the flywheel.

4. The device according to claim 1, comprising means for varying the movement resistance of said two levers.

5. The device according to claim 1, wherein the two levers each have a handgrip or footrest, each of which moves in an arc.

6. The device according to claim 1, wherein the flywheel comprises a freewheel mechanism.

7. The device according to claim 1, wherein the base is configurable to support the two levers in both a first orientation and alternatively in a second orientation, wherein the second orientation changes orientation of the two levers and direction of the periodic push and/or pull forces relative to the first orientation.

8. The device according to claim 7, wherein in the first orientation the two levers can be actuated by the user mainly in forward and backward direction and in the second orientation the two levers can be actuated by the user in mainly upward and downward direction.

9. A device for training the body of a user by using no more than two limbs of the user at the same time, comprising: a base for situating the device on a floor, wherein the base comprises: a floor plate with two slides on an upper side thereof; and a housing securable to the floor plate between the two slides in either a first orientation or a second orientation; two levers to be operated by said no more than two limbs of the user, the two levers being supported by the housing so as to be driven by periodic push and/or pull forces provided by said no more than two limbs of the user, wherein the direction of the periodic push and/or pull forces is different from the first orientation to the second orientation and due to such difference allows the user to train different muscles; a flywheel linked with said two levers and supported by the base, such that movement of the two levers causes rotation of the flywheel, with the flywheel resisting at least relatively fast movement of the two levers, wherein the housing in the first orientation is rotated about a horizontal axis relative to the second orientation.

10. The device according to claim 9, wherein the two levers are arranged to be operated either with the hands or with the feet.

11. The device according to claim 9, wherein each lever is pivotally connected at a first location with a fixed point of the housing, whereas each lever is linked at a second location to a connection rod, with the connection rod being coupled to the flywheel.

12. The device according to claim 9, wherein the housing in the first orientation is rotated 90° about a horizontal axis relative to the second orientation.

13. The device according to claim 12, comprising a seat mounted on top of the housing in the first orientation.

14. The device according to claim 13, comprising handrails provided at sides of the housing.

15. The device according to claim 1, wherein said spring-loaded follower comprises a wheel rotationally riding on the cam.

16. The device according to claim 1, wherein the cam is a cam plate having two bumps per revolution of the crank.

* * * * *